US006098700A

United States Patent [19]

Carden et al.

[11] Patent Number: 6,098,700

[45] Date of Patent: Aug. 8, 2000

[54] APPARATUS FOR DIE CASTING OF METAL MATRIX COMPOSITE MATERIALS FROM A SELF-SUPPORTING BILLET

[75] Inventors: Robin A. Carden, Costa Mesa; Thomas Flessner, Orange, both of Calif.

[73] Assignee: Alyn Corporation, Irvine, Calif.

[21] Appl. No.: 09/241,020

[22] Filed: Feb. 1, 1999

Related U.S. Application Data

[62] Division of application No. 08/834,726, Apr. 1, 1997, Pat. No. 5,865,238.

[51] Int. Cl.[7] ..... B22D 17/10

[52] U.S. Cl. ..... 164/312; 164/900

[58] Field of Search ..... 164/312, 900, 164/113

[56] References Cited

U.S. PATENT DOCUMENTS

| | | | |
|---|---|---|---|
| 3,447,593 | 6/1969 | Nyselius | 164/312 |
| 4,569,218 | 2/1986 | Baker et al. | 164/900 X |
| 4,853,182 | 8/1989 | Cornie et al. . | |
| 5,303,761 | 4/1994 | Flessner et al. . | |
| 5,322,109 | 6/1994 | Cornie . | |
| 5,477,905 | 12/1995 | Knapp et al. . | |
| 5,486,223 | 1/1996 | Carden . | |
| 5,553,658 | 9/1996 | Cornie . | |
| 5,575,325 | 11/1996 | Sugiura et al. | 164/312 X |
| 5,730,201 | 3/1998 | Rollin et al. | 164/312 X |

FOREIGN PATENT DOCUMENTS

| | | | |
|---|---|---|---|
| 61-137663 | 6/1986 | Japan | 164/113 |
| 63-224857 | 9/1988 | Japan . | |
| 1-254364 | 10/1989 | Japan | 164/900 |
| 2-251353 | 10/1990 | Japan . | |
| 3-13259 | 1/1991 | Japan | 164/900 |

OTHER PUBLICATIONS

M.C. Flemings et al., "Rheocasting," McGraw–Hill Yearbook of Science and Technology, 1978, pp. 49–58.

*Primary Examiner*—J. Reed Batten, Jr.
*Attorney, Agent, or Firm*—Cooper & Dunham LLP

[57] ABSTRACT

Apparatus for die casting a shape from a metal matrix composite billet composed essentially of a metal alloy matrix and dispersed ceramic particles, comprising heating means to soften the metal alloy; a horizontal plunger to drive and to compress the billet; a die through which the softened metal matrix and ceramic particles are formed into a shape defined by the interior surface of the die; and cooling means to maintain the temperature of the interior surface of the die at a predetermined temperature.

7 Claims, 5 Drawing Sheets

APPARATUS FOR DIE CASTING OF METAL MATRIX COMPOSITE MATERIALS FROM A SELF-SUPPORTING BILLET

CROSS-REFERENCE

This is a divisional application of U.S. Ser. No. 08/834,726, filed Apr. 1, 1997, now U.S. Pat. No. 5,865,238, issued Feb. 2, 1999.

BACKGROUND OF THE INVENTION

The present invention relates generally to the field of die casting of metal matrix composite materials. More particularly, the present invention relates to die casting of such materials from a semi-solid billet where a solid oxide coating supports a softened interior.

Die casting is a well-known process for forming metal parts by injecting a molten metal into a die cavity, allowing the metal to solidify and removing the part from the die. In using that process, the metal is heated in a crucible to a temperature above its melting point. The liquid metal is poured into an injecting sleeve forming a "shot." A plunger is pushed into the sleeve to slowly displace the material to the entrance of a mold cavity. The plunger then is driven rapidly into the sleeve forcing the shot into the mold cavity. The walls of the mold cavity are cooled so that the metal begins to solidify as it enters the cavity.

Conventional die casting techniques suffer from several problems. Porosity of die cast parts reduces their strength. The range of materials that are readily die cast have relatively low strength and wear resistance. The transfer of liquid metals is cumbersome, may result in contamination of the material from contact with containers, and is a safety hazard to workers and equipment.

Porosity is caused by air and other gases mixed with the metal shot. Gases may become mixed with the metal due to decomposition of impurities, by air entrained in the liquid metal as it is poured into the sleeve or by the injection of air trapped in the sleeve along with the metal shot.

Porosity may be reduced by applying high pressure to the plunger at the end of the injection cycle before the material has solidified. This technique, called compaction, is most effective where solidification is slow. Solidification may be slowed by using a higher melt temperature. However, a higher melt temperature increases shrinkage of the part as it solidifies, reducing the dimensional accuracy of the finished part.

Compaction may also be made more effective by providing an entrance to the mold cavity, called the gate, with a wider cross-section. Gate sizes are limited in conventional die casting processes because the linear velocity of the material entering the mold must remain above a certain minimum, usually about 100 feet per second, to distribute porosity uniformly. Rapid solidification across the restricted gate cross section limits the effectiveness of compaction.

The types of materials that may be used to form the die cast part are limited by the need to inject in a liquid state. Castable materials must have a low enough melting temperature that the die is not damaged by contact with the liquefied materials. As a consequence, die casting is usually limited to alloys of aluminum, magnesium or zinc. Such materials tend to have lower strength and are more prone to wear than higher melting point metals.

A technique known as thixocasting has been proposed to avoid some problems associated with the use of liquid metals in conventional die casting processes. This process is described, for example, in "Rheocasting", Flemings, Merton et al., McGraw-Hill Yearbook of Science and Technology, 1978, pp. 49–58. A billet of material is formed by first heating a metal alloy to form a liquid melt. The liquid metal then is cooled while it is vigorously agitated. As the metal cools, higher melting point alloys solidify from the liquid in the form of dendritic crystals. Agitation breaks up dendritic crystals into globular particles forming a slurry. The slurry is poured into a preform mold and cast as a billet.

The resulting billet, called a rheocast billet, has a microstructure with a lower melting point continuous phase surrounding a finely dispersed higher melting discrete phase. The rheocast billet then is reheated to a temperature where the continuous phase melts but the discrete phase remains solid, causing the billet to become semi-solid. The semi-solid billet is transferred to an injection molding sleeve and is injected into a cooled die.

The finely dispersed discrete phase gives thixocast materials improved strength over conventionally cast material. Porosity is improved over conventional die casting because liquid metal is not poured into the injection sleeve. Also, handling of semi-solid billets is safer and less cumbersome than transferring liquid metal.

Thixocasting has certain drawbacks. Ineffective agitation of the rheocast material, especially along the sides of the melting crucible, can allow the formation of large dendritic crystals that may interrupt the flow of material into the die and may mar the surface of the finished part. Porosity of the finished part still is a problem since air and gases may be introduced into the rheocast billet by decomposition of contaminants. Air may also be entrained into the slurry when it is transferred to the preform mold. Controlling the temperature of the semi-solid billet is critical. If the temperature is too high the billet will deform or liquefy before it is transferred to the injection apparatus. If the temperature is too low the material will not flow properly into the mold cavity.

The strength and hardness of low melting point alloys can also be improved by adding ceramic particles to form a metal matrix composite. The composite is less dense than metals with an equivalent tensile strength and can be used to fabricate lighter parts. For example, U.S. Pat. No. 5,486,223 (Carden) describes a method of forming an aluminum-based metal matrix composite wherein boron carbide particles and an aluminum alloy powder are blended, compressed and sintered to form a solid. The resulting material is harder, stronger, stiffer and less dense than castable grades of aluminum alloy alone.

Die cast composite materials made using conventional techniques suffer from the same problems of porosity and cumbersome materials handling as do castings made with metal alloys alone. Additionally, many ceramic materials are not easily wet by certain metal matrix materials. Gases that remain trapped on the ceramic particle surfaces may lead to porosity. High-shear mixing is often required to get these materials to mix. The mixing process may also introduce gases into the material.

Methods of casting metal ceramic composites under vacuum to reduce porosity have been proposed. For example, U.S. Pat. No. 5,322,109 (Cornie) describes a casting method wherein a ceramic material in the form of a fibrous preform is placed inside a mold cavity. Connected to the mold cavity is an infiltrant chamber holding a metal charge. The mold and the infiltrant chamber are heated under a vacuum to melt the charge. The mold and chamber are transferred to a pressure vessel and the liquefied metal charge is forced into the mold cavity, infiltrating the preform. This method can produce parts with desirable strength and hardness properties, and with reduced porosity.

The process is cumbersome, however, requiring the production of preforms for each injected part and the transfer of the molding apparatus from a vacuum furnace to a pressure vessel.

SUMMARY OF THE INVENTION

In view of the aforementioned shortcomings of known die casting processes, it is an object of the present invention to provide a die casting process that produces parts with improved strength, better wear characteristics and lower porosity.

It is another object of the present invention to provide a die casting process wherein casting materials may be handled as self-supporting billets for transfer to the die casting apparatus.

It is a still further object of the present invention to provide an easily used process for casting metal matrix composite materials with improved porosity characteristics.

The present invention is directed to a process and apparatus for die casting wherein the die cast material is a metal matrix composite.

A metal matrix composite may be formed by mixing ceramic particles with a liquefied alloy. This mixture is then placed in a vacuum to reduce the amount of gas trapped in the mixture.

Alternatively, a metal matrix composite material may be formed by mixing a powdered matrix material with ceramic particles and applying pressure and heat to sinter the mixture into a solid mass. Gases can be nearly eliminated from such materials, with the resulting mass having a density approaching 99% of its theoretical maximum density. Formation of aluminum alloy composite materials using a powder metallurgy process is described, for example, in U.S. Pat. No. 5,486,223 (Carden), which is incorporated herein by reference.

Reference made to ceramic particles is to be understood to include finely divided ceramic materials in the form of spheroids, whiskers, fibers, flakes, or other shapes with dimensions in the range of particle sizes described herein.

According to an aspect of the present invention, there are provided a method and apparatus whereby an aluminum alloy composite material is formed into a cylindrical billet of a predetermined diameter and volume. The resulting billet is heated in an oxygen-containing atmosphere. Exposure to oxygen at an elevated temperature causes a rigid aluminum oxide coating to form on its surface. This coating has a significantly higher melting point than the aluminum matrix material and is strong enough to withstand handling of the billet.

The billet is heated to a temperature above the melting point of the aluminum matrix, softening the composite material in the interior of the billet to form a semi-solid or highly viscous fluid. The aluminum oxide coating, however, remains solid and supports the softened material.

The self-supporting billet is transferred to a die casting sleeve. A plunger is forced into the sleeve behind the billet. Compression of the billet disrupts the aluminum oxide coating and allows the semi-solid material to flow.

A die cavity is provided at the end of the sleeve opposite the plunger. The plunger rapidly displaces the semi-solid material into the die cavity. The plunger compacts the material in the die cavity by applying high pressure. The material cools in the die cavity and solidifies, forming the cast part.

Compaction in the present invention is more effective than with conventional die casting processes because larger gate sizes may be used. The semi-solid cast material contains very little trapped gases. High entrance velocities are not required to distribute porosity. Thus, compaction pressure may be applied for a longer period of time before the material across the larger gate cross-section solidifies.

The volume of the billet is selected to be substantially equal to the volume of the finished part. This reduces waste material and simplifies subsequent machining steps. The billet is shaped so that its diameter is only slightly smaller than the inside diameter of the injection sleeve. This minimizes the volume of air injected along with the shot, reducing the porosity of the cast part.

In another aspect of the present invention, there are provided a method and apparatus for die casting a sequence of parts. Several preheated aluminum matrix composite billets are held in a preheat oven at a temperature near the melting temperature of the matrix. The billets are sequentially removed from the oven, heated by an induction coil and injected into a mold by an injection sleeve and plunger. Preheating the billets speeds production of parts.

DETAILED DESCRIPTION

Figure 1:
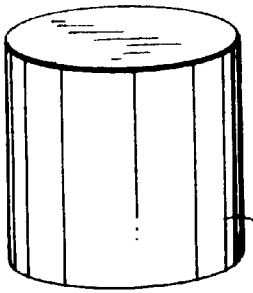
FIG. 1 shows a billet according to the present invention.
Figure 2:
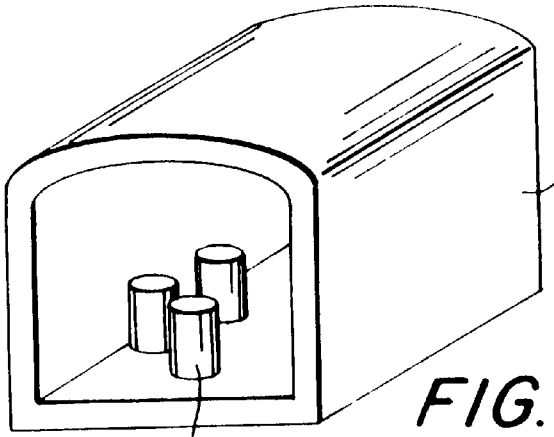
FIG. 2 shows an oven used in a first embodiment of the present invention.
Figure 3:
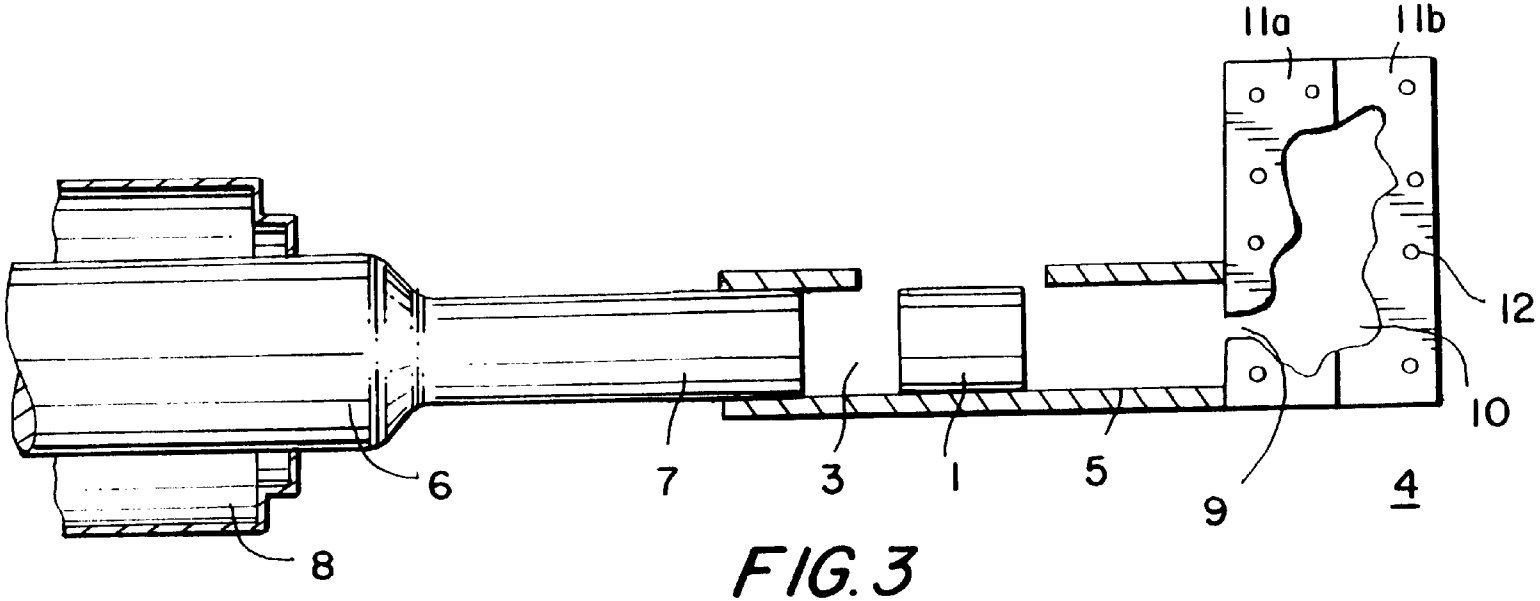
FIG. 3 shows a die casting apparatus used in a first embodiment according to the present invention.

In a first embodiment of the present invention, shown in FIGS. 1, 2 and 3, a billet 1 is formed by blending a powdered metal alloy with ceramic particles. The metal alloy may consist of 97% aluminum with 1% magnesium, 0.6% silicon and 0.2% chromium and trace quantities of copper, iron, titanium and zinc, for example. Other alloy compositions may be used for example, aluminum, magnesium, zinc, titanium and alloys thereof. To this matrix is added, by way of example, 12% by weight 99.5% pure boron carbide particles with a size range of 2–40 microns and a mean size of 10 microns. Other ceramic particles could also be used, for example, silicon carbide, aluminum oxide, aluminum nitride, magnesium oxide, silicon oxide, zirconium oxide, beryllium oxide, titanium carbide, titanium boride, tungsten carbide or combinations thereof. The matrix and ceramic materials are blended, shaped into a cylindrical billet, isopressed, degassed, and sintered in the manner disclosed in U.S. Pat. No. 5,486,223 (Carden).

Preferably, the diameter of the billet 1 is selected to be slightly smaller than the interior of the sleeve 5 so that when the billet 1 is pushed into the sleeve 5 most of the air in the sleeve 5 is displaced. The volume of the billet 1 is selected to be substantially equal to that of the die cavity 10. For example, the billet 1 may be about two inches in diameter and approximately two inches in height.

The billet 1 is placed in a preheat oven 2 and heated to 1300 degrees Fahrenheit in ambient air, as shown in FIG. 2. The billet 1 then is placed in a receiving chamber 3 of a die casting apparatus 4, as shown in FIG. 3. The interior of the sleeve 5 of the die casting apparatus 4 is approximately two inches in diameter so as to receive the billet 1. The billet 1 is a semi-solid and has a rigid aluminum oxide coating.

A piston 6 having a plunger tip 7 extends into a hydraulic cylinder 8. Pressure applied to the piston 6 by the hydraulic cylinder 8 drives the plunger tip 7 into the sleeve 5. The plunger tip 7 pushes the billet 1 into the sleeve 5 of casting apparatus 4.

The plunger tip 7 then is rapidly moved into the sleeve 5 at a speed of between 50 and 150 inches per second, disrupting the aluminum oxide coating of the billet 1 and forcing the semi-solid billet 1 through the gate 9 of a die cavity 10. The temperature of the die cavity 10 is maintained at approximately 375 degrees Fahrenheit by the flow of coolant through coolant channels 12 in die halves 11*a*, 11*b*. A compaction pressure of 8000–9000 pounds per square inch is applied to the plunger tip 7 by the piston 6 at the end of the injection cycle before the injected material has solidified. The die halves 11*a*, 11*b* then are separated and the finished part (not shown) removed.

Figure 4:
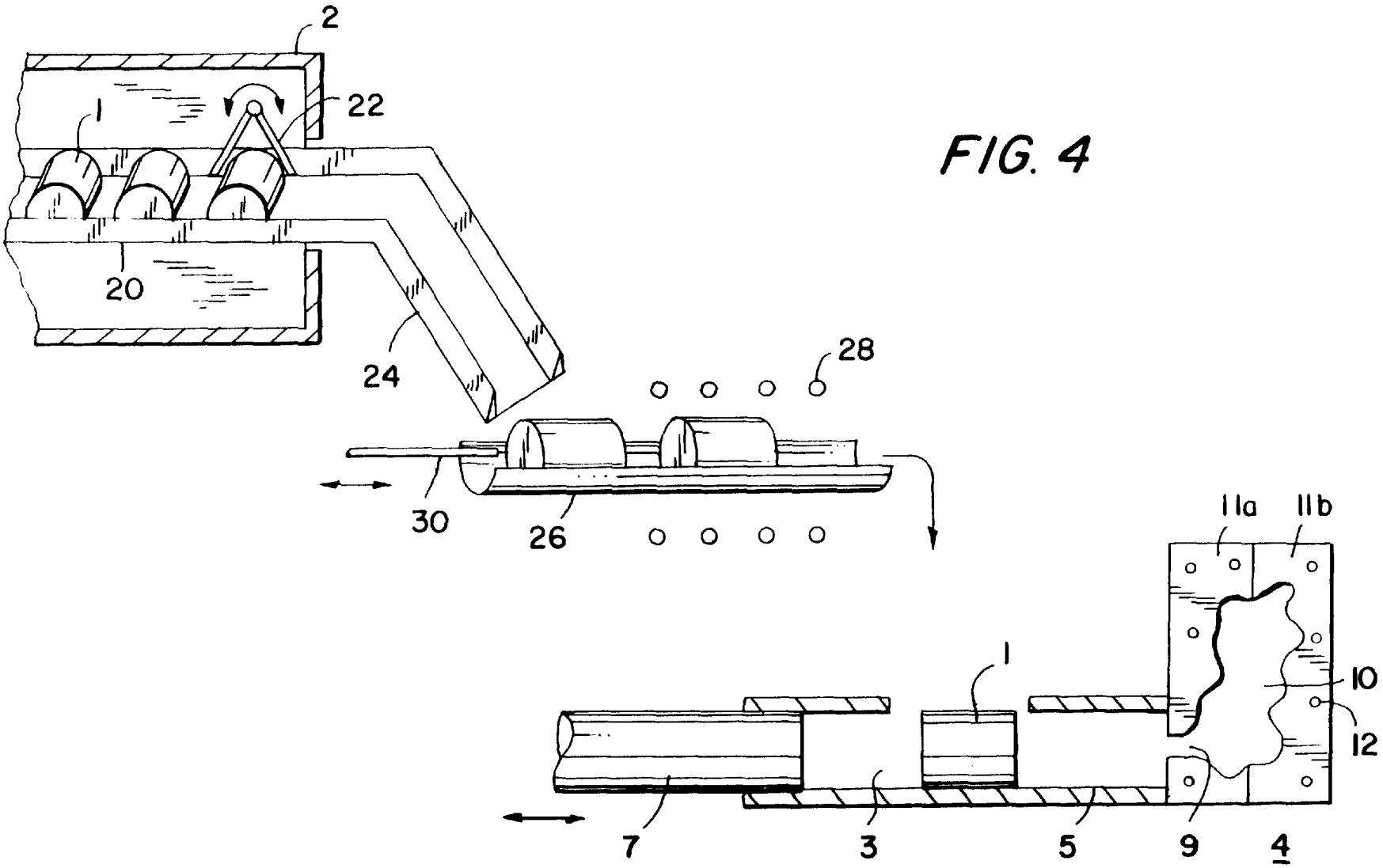
FIG. 4, shows an apparatus used in a second embodiment of the present invention.
Figure 5:
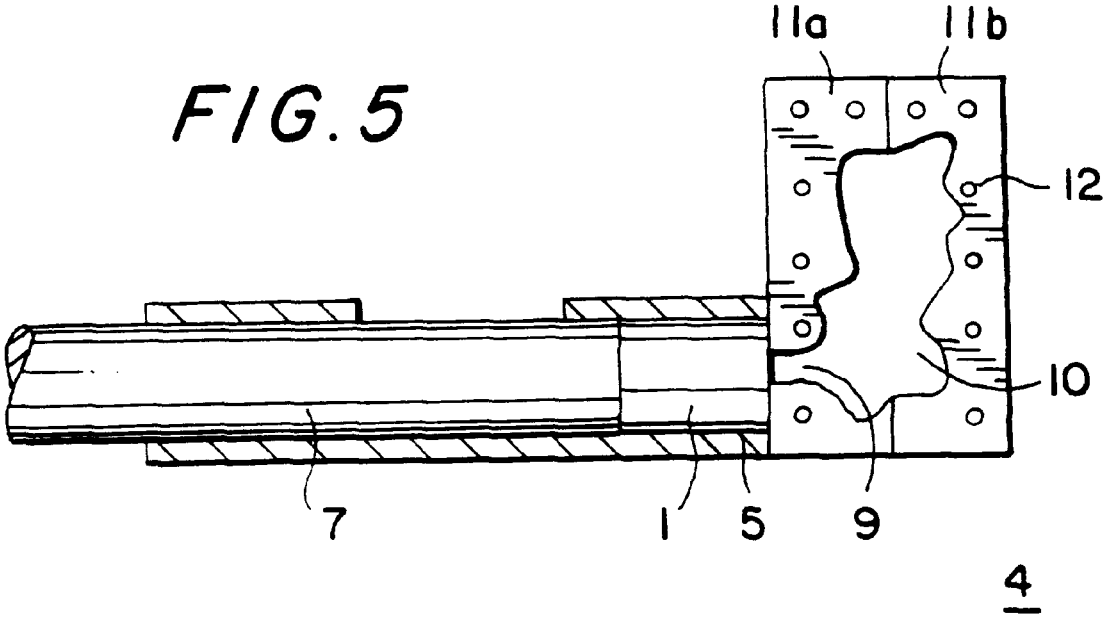
FIG. 5 shows another aspect of the apparatus shown in FIG. 4.
Figure 6:
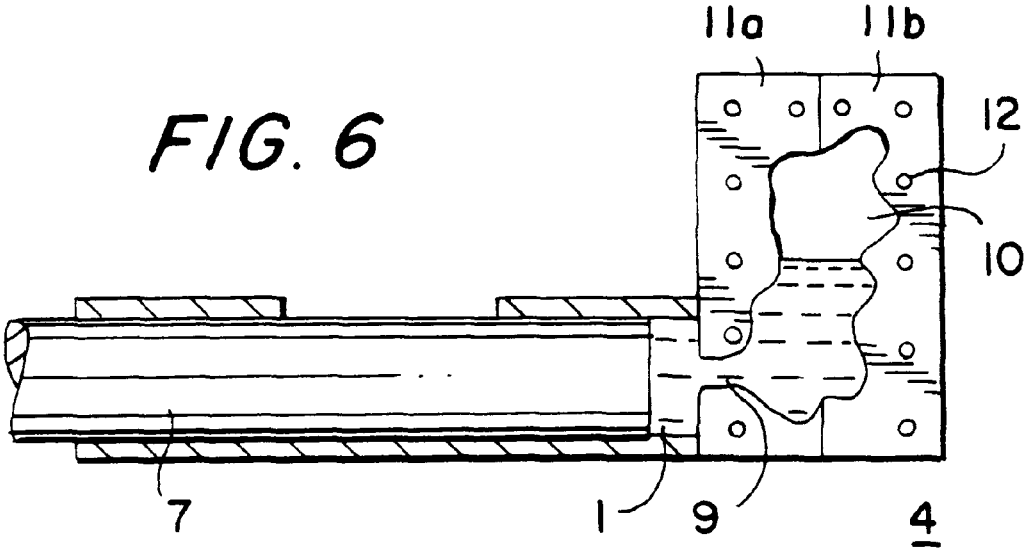
FIG. 6 shows yet another aspect of the apparatus shown in FIG. 4.

FIGS. 4, 5 and 6 show a second embodiment of the present invention. A number of billets 1 are formed of a metal matrix composite material comprising an aluminum alloy matrix in which is dispersed ceramic particles constituting 2% to 40% of the weight of the billet. The ceramic particles range in size from 2 to 19 microns. The billets 1 are held in a preheat oven 2 on a rack 20 at a preheat temperature, typically 900 degrees Fahrenheit, that is below the melting temperature of the matrix material, around 1100 degrees Fahrenheit. The oven 2 is provided with an oxygen-containing atmosphere.

A billet 1 is pushed from the oven 2 by a rotating arm 22 and caused to roll down an incline 24 and onto a tray 26. Surrounding one end of the tray 26 is an induction heating coil 28. A push rod 30 moves a preheated billet 1 along the tray 26 until it is surrounded by the induction heating coil 28. Electrical current is caused to flow through the induction coil 28 to heat the billet 1 to a temperature of about 1300 degrees Fahrenheit, that is above the melting point of the matrix.

Because the billet is exposed to oxygen, an aluminum oxide coating forms at its surface. This coating causes the billet 1 to maintain its shape as the matrix material in its interior softens.

The push rod 30 then pushes the billet 1 over the end of the tray 26 where it falls into a receiving chamber 3 of an injection molding apparatus 4.

A piston (not shown) drives a plunger tip 7 into the billet 1, to push the billet 1 into a sleeve 5 of the injection molding apparatus 4, as shown in FIG. 5. The diameter of the sleeve 5 is selected to be substantially the same as the diameter of the billet so that most of the air in the sleeve 5 is displaced by the billet 1. The plunger tip 7 then is driven forward rapidly, as shown in FIG. 6. Typically, the plunger tip 7 is driven at 50–150 inches per second. The rapid displacement of the plunger tip 7 causes the aluminum oxide layer on the surface of the billet 1 to be disrupted. The billet 1 is forced into the die cavity 10 through the gate 9. The billet 1 enters the die cavity 10 in a uniform manner, filling the cavity in approximately 15–20 milliseconds.

The plunger tip 7 then is driven forward and applies pressure to compact the billet 1 into the die cavity 10. The die halves 11*a*, 11*b* are cooled by coolant channels 12 to a temperature low enough to solidify the matrix material, typically 375 degrees Fahrenheit.

The die halves 11*a*, 11*b* are separated and the finished part (not shown) is removed from the injection molding apparatus 4. The plunger tip 7 is retracted to the position shown in FIG. 4. Another preheated billet 1 is rolled from the preheat oven 2 by the rotating arm 22, heated by the induction coil 28 and pushed into the receiving chamber 3. The process is repeated.

Figure 7:
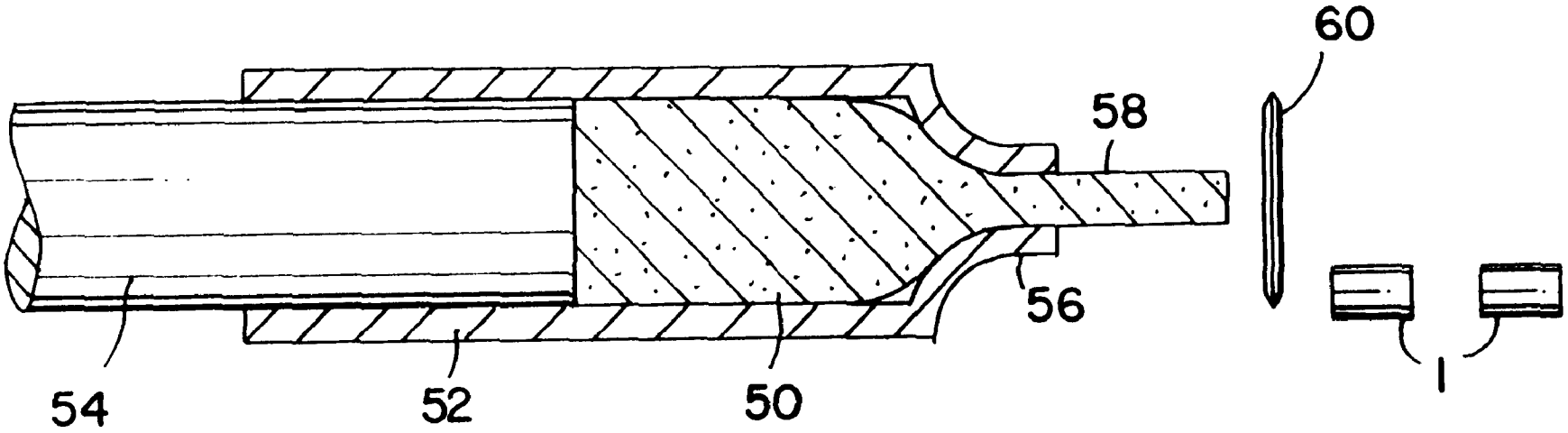
FIG. 7 shows a method of forming billets for use with the first and second embodiments of the present invention.

FIG. 7 shows an alternative method of forming composite billets 1 according to the present invention. An extrusion billet 50 of a metal matrix composite Material is formed by blending, compressing and sintering matrix metal powders and ceramic particles. The extrusion billet 50 is placed in an extrusion sleeve 52 and is compressed by an extrusion plunger 54. The billet 50 is forced through a die 56. The inner diameter of the die 56 is slightly smaller than the inner diameter of the sleeve 5 shown in FIGS. 3, 4, 5 and 6.

The billet 50 forms an extruded cylinder 58 after passing through the die 56. The extruded cylinder 58 then is cut by a saw 60 into billets 1 each of a volume that is substantially equal to the volume of the mold cavity 10 shown in FIGS. 3, 4, 5 and 6. The billets 1 then are used to make die cast parts according to one of the two embodiments described above.

Figure 10:
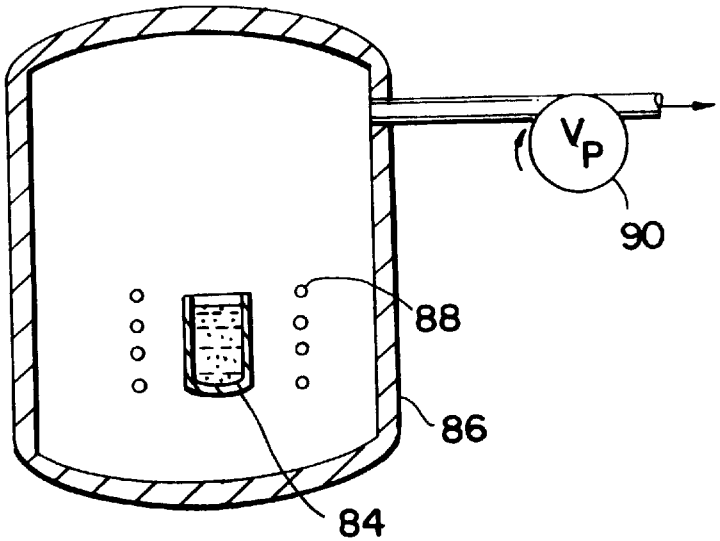
FIGS. 8, 9 and 10 show another method of forming billets for use with the first and second embodiments of the present invention.
Figure 8:
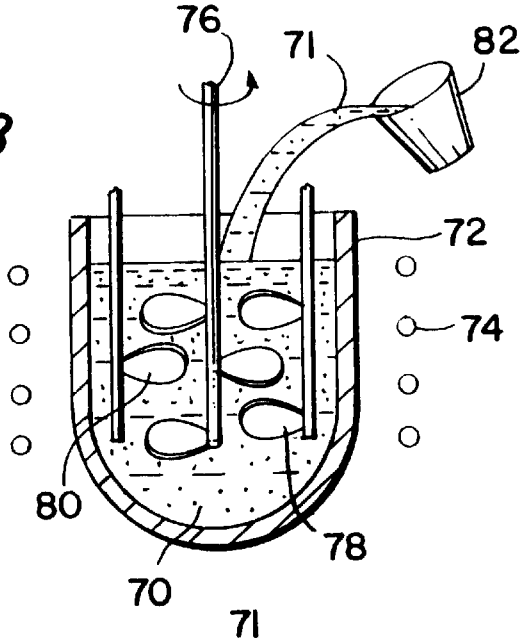
Figure 9:
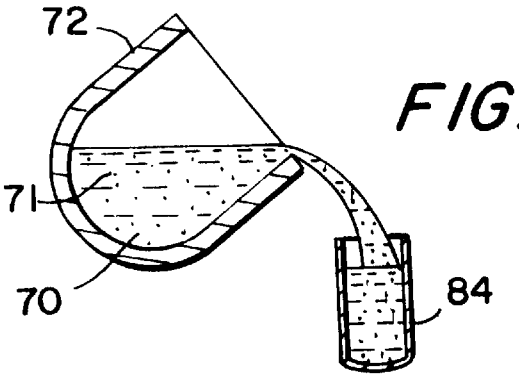

FIGS. 8, 9 and 10 show another alternative method for forming billets 1 according to the present invention. A liquefied metal charge 70 is heated in a crucible 72 by an induction coil 74. A shaft 76 turns impeller blades 78. Stator blades 80 are disposed close to the path of the impeller blades 78 so that the combination of the stators 80 and impellers 78 form a high-shear mixer. While the metal charge 70 is being heated by the coil 74 and mixed by the impellers 78, ceramic particles 71 are added to the charge from a container 82. The metal charge 70 and ceramic particles 71 are blended by the impellers 78 and stators 80.

The composite of the liquid metal charge 70 and the ceramic particles 71 is poured into a preform mold 84, as shown in FIG. 9. The preform mold 84 is placed in a chamber 86 and within induction coils 88, as shown in FIG. 10. The composite is heated by the induction coils 88 and a vacuum is drawn on the chamber 86 by a vacuum pump 90. Trapped gases within the liquid metal charge 70 are drawn out by the vacuum pump 90 and expelled from the apparatus.

The induction coils 88 are turned off and the composite is allowed to cool and solidify, forming the billet 1. The billet 1 is removed from the preform mold 84 and is die cast using one of the embodiments described above.

The embodiments described above are illustrative examples of the present invention. It should be understood that the present invention is not limited to these particular embodiments. Various changes may be effected by one skilled in the art without departing from the spirit or scope of the invention as defined in the appended claims. For example, other methods of forming metal matrix composite materials, including pressure or vacuum infiltration of ceramic particles by a liquefied matrix, may be used.

What is claimed is:

1. Apparatus for die casting a shape from a metal matrix composite billet composed essentially of a metal alloy matrix and dispersed ceramic particles, comprising:

(a) preheating means for heating said metal matrix composite billet to a temperature below a softening temperature of the metal alloy;

(b) a rotating arm for ejecting the billet from the preheating means to means for receiving the ejecting billet, wherein said billet is transferred to heating means;

(c) heating means with an oxygen-containing atmosphere for heating the billet, whereby an oxide coating is developed at the surface of the billet and the matrix is heated above a softening temperature of the metal alloy;

(d) a horizontal sleeve;

(e) transfer means for transferring the billet from the heating means to the horizontal sleeve;

(f) a horizontal plunger initially disposed at a proximal end of the horizontal sleeve;

(g) plunger driving means for driving the horizontal plunger through the horizontal sleeve and toward a distal end of the horizontal sleeve and for compressing the billet, thereby disrupting the oxide coating and displacing the matrix and ceramic particles;

(h) a die connected to the distal end of the sleeve for receiving the matrix and ceramic particles so that the softened matrix and ceramic particles are formed into a shape defined by the interior surface of the die; and (i) cooling means for maintaining the temperature of the interior surface of the die at a predetermined temperature.

2. The die casting apparatus according to claim 1 wherein the ceramic particles are selected from the group consisting essentially of silicon carbide, aluminum oxide, aluminum nitride, boron carbide, magnesium oxide, silicon oxide, zirconium oxide, beryllium oxide, titanium carbide, titanium boride, tungsten carbide or combinations thereof.

3. The die casting apparatus according to claim 1 wherein the oxide coating is cohesive and supports the softened matrix material.

4. The die casting apparatus according to claim 1 wherein the heating means comprises:

an induction coil surrounding the ejected billet for heating the ejected billet to a temperature above the softening temperature, wherein the plunger driving means drive the horizontal plunger at a speed of between about 50 and 150 inches per second.

5.The die casting apparatus according to claim 4 wherein the plunger compresses the billet at a pressure of about 8000 to 9000 pounds per square inch.

6. The die casting apparatus according to claim 1 wherein the volume of the billet is substantially equal to the volume enclosed by the interior surface of the die.

7. The die casting apparatus according to claim 1 wherein the metal alloy is composed essentially of 97% aluminum, 1% magnesium, 0.6% silicon, and 0.2% chromium; the ceramic particles are composed essentially of 99.5% boron carbide particles with a range of particle sizes between 2 and 40 microns; and the ceramic particles comprise 2% to 40% by weight of the composite material.

* * * * *